United States Patent [19]

Mann

[11] 4,034,401

[45] July 5, 1977

[54] OBSERVER-IDENTIFICATION OF A TARGET OR OTHER POINT OF INTEREST IN A VIEWING FIELD

[75] Inventor: George Mann, Winchcombe, England

[73] Assignee: Smiths Industries Limited, London, England

[22] Filed: Apr. 21, 1976

[21] Appl. No.: 678,795

[30] Foreign Application Priority Data

Apr. 22, 1975 United Kingdom ..... 16701/75

[52] U.S. Cl. ..... 358/93; 358/107; 358/109; 358/113; 351/7; 356/152; 33/262

[51] Int. Cl.[2] ..... H04N 3/00; H04N 7/18

[58] Field of Search ..... 358/104, 107, 109, 113; 235/61.5 S, 61.5 E; 351/7; 356/152; 33/262

[56] References Cited

UNITED STATES PATENTS 3,262,210 7/1966 Shapiro ..... 33/262

*Primary Examiner*—Robert L. Richardson
*Assistant Examiner*—Edward L. Coles
*Attorney, Agent, or Firm*—Pollock, VandeSande & Priddy

[57] ABSTRACT

A head-up display system in a military aircraft provides projection of flight and weapon-aiming information into the pilot's line-of-sight through a partially-transparent reflector. The pilot operates a button firstly when he recognizes a target viewing through the display and then again when he fixes his eye on an aiming marker in the display. On each occasion of button operation a measure of his eye position is entered into the system to derive coordinates of the identified target related to the marker position in the display, for generation of the appropriate shifts to move the marker into register with the identified target. The measure of eye position is provided in each case by analysis of video-signal waveforms derived by a vidicon camera that is carried on the pilot's helmet and scans reflection in the helmet-visor of the pilot's eye as illuminated, also by reflection in the visor, from an infra-red source. The analysis involves determination from the video signals of successive line-scans of the eye-image, of the boundaries of the iris (or pupil) in relation to both the frame and line time-bases, and computation therefrom of coordinates of the centerpoint of the pupil. Compensation for head movement in the interval between the two measurements of eye position is provided in accordance with variation during that interval of the phasing (in the time-bases) of response to two arrays of point-sources mounted on said reflector.

14 Claims, 6 Drawing Figures

OBSERVER-IDENTIFICATION OF A TARGET OR OTHER POINT OF INTEREST IN A VIEWING FIELD

This invention relates to display or other systems that involve observer-identification of a target or other point of interest. The invention is applicable to weapon-aiming systems, but is not limited to such systems.

There is a requirement in weapon-aiming systems as used in aircraft or other military operations for an observer having recognized a potential target, to enter identification of the location of this target into the system rapidly. An existing technique involves the use of a hand controller for positioning a display marker in register with the target so as thereby to identify the coordinates of the target-location in the viewing field. In most situations a high degree of skill is required to position the marker accurately, and also the tactical advantage of the system may be degraded by the time delay in performing the marking operation. It is one of the objects of the present invention to provide a system by which these disadvantages can be overcome or reduced.

According to one aspect of the present invention there is provided a system in which the location of a selected point within the field of view of an observer is identified within the system in accordance with a measure of eye position of the observer when looking at that point. The origin or reference to which the measurement is related is derived from a corresponding measure of eye position when the observer is looking at a reference point defined in relation to the field.

The reference point may be a point within the same field of view as that of the selected point, and in this respect its location may be indicated to the observer by a display symbol that appears, or is caused to appear, in the field. Where the observer is to view an external scene directly, an image of the display symbol may be projected, for example onto a partially-transparent reflector within the observer's line of sight, to appear against the background of the external scene. However where a display of such a scene, as provided for example by radar or television equipment, is to be viewed, then the symbol may be superimposed approximately in the generation of that display.

The measurements of eye position may be derived during operations that immediately follow one after the other. More especially, the observer may first search for a potential target or other point of interest in the field of view and once having recognized such point and fixed his eye on it, may then signify this to the system, for example by operation of a pushbutton. The response of the system may be to record an arbitrarily-related measure of the eye position and then present to the observer, or otherwise direct his attention towards, a reference marker that has a known location within the field of view. Once the observer has transferred his eye to the reference marker and signified the fact to the system, the system may compute appropriate coordinates of location of the identified target or other point of interest within the field, by reference both to the recorded measure of eye position and the corresponding measure made of the eye position when the reference marker is viewed.

It is possible for the measure of eye position to the reference marker to be derived before, rather than after, the measure of eye position to the target or other point of interest. In either case the value or values appropriate to such measure may be recorded for use with the measure of eye position made in relation to a plurality of targets or other points of interest.

Measurement of eye position may be achieved using an imaging sensor, such as a vidicon tube or a charge-coupled semiconductor device, that is arranged to view the eye, and means for analyzing the video signal derived to determine coordinates of the centre of the eye-pupil. The eye may be illuminated with radiation within a narrow band of wavelengths, for example with infra-red radiation, and the imaging sensor may then be arranged to be especially responsive to that band of wavelengths. If gated or other modulation of the illumination is also provided, a high signal-to-noise ratio can be achieved to enable accurate determination of the coordinates of the eye-centre in the field of view of the sensor. Illumination of the eye, or viewing of the eye by the imaging sensor, or both, may be by reflection from, for example, a visor that is carried on a helmet worn by the observer. Further, illumination of the eye may be confined to the period of measurement.

It may be possible in certain circumstances to assume that there is no movement of the head of the observer in the interval between the measurement of eye position to the target or other point of interest, and the measurement of eye position to the reference marker. Where this is not the case it will be necessary to determine either the position or orientation, or in most cases both, of the head when each measurement of eye-position is made, and to compensate for the difference accordingly in the output representation of the location of the target or other point.

The present invention according to another of its aspects provides a system that may be used in the above context for determining the position or orientation, or both, of the head. The equipment, which is applicable where eye-position is to be determined also, but is not limited to this, comprises means for presenting a distinctive optical pattern, imaging-sensor means for viewing said pattern to produce video signals in accordance therewith, one of the two said means being adapted to be carried by the head, and means for analyzing said pattern to determine therefrom the relative position or orientation, or both, of the head relative to the other of said two means.

Systems in accordance with either of the above-identified aspects of the present invention may be used in a military context, but are equally applicable outside this. For example, such systems are applicable where there is to be observer-identification of one or more items selected from within an alpha-numeric or other information display. However they are especially applicable in the context of head-up display systems as used in military aircraft.

A head-up display system for use in a military aircraft, in accordance with the present invention, will now be described, by way, of example, with reference to the accompanying drawings, in which.

Figure 1:
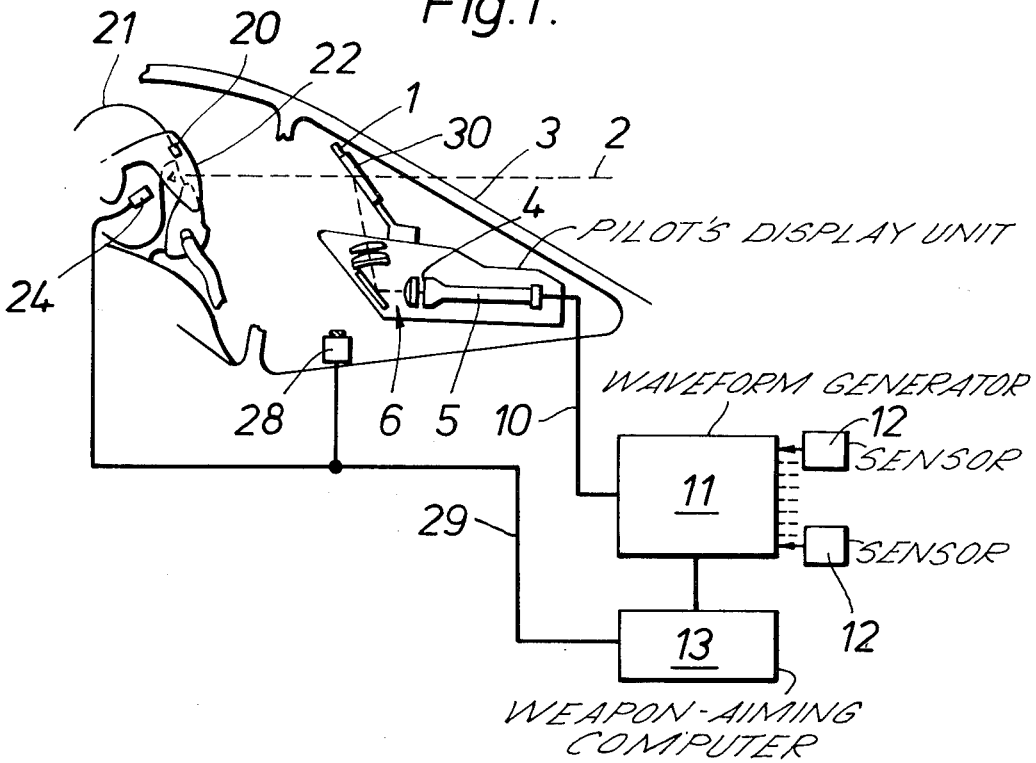
FIG. 1 is illustrative of the head-up display system as installed in the aircraft.

Referring to FIG. 1, a partially-transparent reflector 1 of the pilot's display unit is mounted in front of the pilot inclined to his line-of-sight 2 through the aircraft-windscreen 3. A display of flight and weapon-aiming information is projected onto the reflector 1 so that the pilot sees the display image in his line of sight 2 against the background of the external scene through the windscreen 3. The display is projected from the screen 4 of a cathode-ray tube 5 within the pilot's display unit, by an optical system 6 that serves to focus the image seen by the pilot, substantially at infinity.

Figure 2:
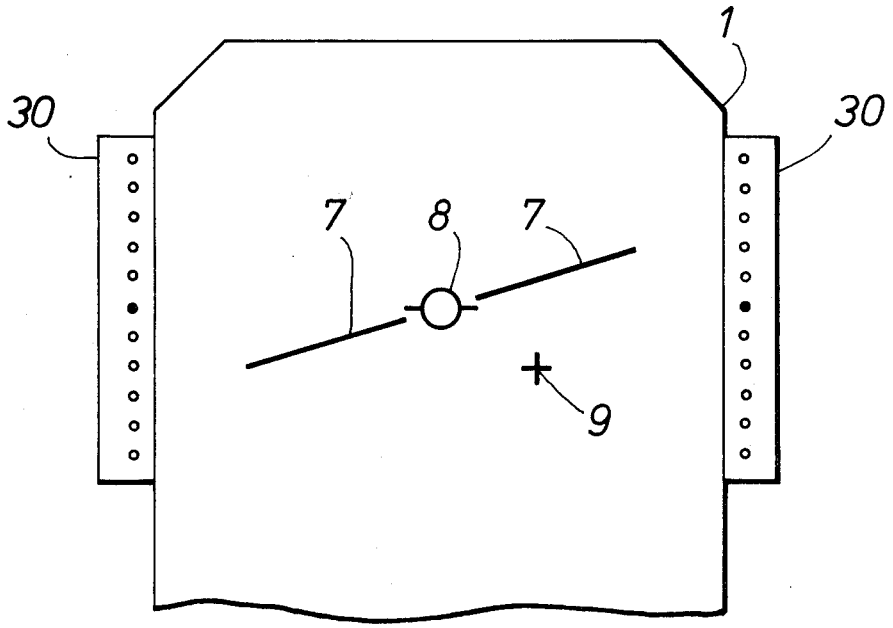
FIG. 2 illustrates symbology as projected by the pilot's display unit of the system of FIG. 1, for viewing against the background of the external scene from the cockpit of the aircraft.

The information displayed in the reflector 1 includes, as illustrated in FIG. 2, analogue presentation of aircraft attitude involving an horizon symbol 7 (in the form of two spaced and aligned bars) and a flight-vector symbol 8 (in the form of a circle with short laterally-extending arms). The flight-vector symbol 8 remains stationary on the screen 4 of the cathode-ray tube 5 and so its image remains stationary in the pilot's field of view through the reflector 1. The horizon symbol 7, however, moves so as to be seen by the pilot to be displaced angularly, and also up and down, relative to the symbol 8, in accordance with bank and pitching movements respectively of the aircraft. The weapon-aiming information on the other hand, involves a marker symbol 9 (illustrated in the form of a cross) that is moved in the display on the screen 4 so as to be seen by the pilot in image against the external scene through the windscreen 3. The symbol 9 denotes in relation to the external scene the line of aim of the aircraft weapon-system (or a selected part of it) to an identified target, and the pilot's task is to manoeuvre the aircraft to bring the symbol 9 within the flight-vector symbol 8 and accordingly align the aircraft appropriately for firing of the weapon system.

The electric time-base and video signals required to produce the display of flight and weapon-aiming information on the screen 4, are supplied to the cathode-ray tube 5 via a multi-lead cable 10 from a waveform generator 11. The waveform generator 11 generates the relevant video signals in accordance with signals it receives from appropriate attitude, and other, sensors 12 and a weapon-aiming computer 13. In this respect it is to be understood that the display as generated and embodied in the video signals supplied via the cable 10 to the cathode-ray tube 5, may embrace a wider variety of information than that involved in the basic form illustrated in FIG. 2. Any of the information may be presented in digital or analogue form, or both.

To the extent that the system shown in FIG. 1 has so far been described, it constitutes a head-up display system of conventional form used in military aircraft. With such a system it is necessary for the pilot having once recognized a desired target in the external scene, to identify the location of this target to the weapon-aiming computer 13. The weapon-aiming computer 13 responds to the identification of target-location to maintain the symbol 9 of the projected display in register with the target as seen by the pilot in the external scene through the reflector 1. The ability of the computer 13 to maintain such registration throughout the motion of the aircraft and any changes of its attitude, depends on the accuracy with which the location of the target is initially identified to the computer by the pilot. Additionally, the usefulness of the facility and its tactical advantage depend very much on the speed with which this identification of target location is made.

An existing technique for identifying target location involves the use of a hand controller that is manipulated by the pilot to move a marker such as the marker 9, into register with the desired target. Once this has been achieved the pilot operates a pushbutton switch to enter the coordinates of the marker into the computer as identification of the target location. Although accuracy in target identification to the computer can be achieved in this way, manipulation of the hand controller to position the display marker precisely onto the target in the moving aircraft, necessitates exercise of substantial skill by the pilot. A significant loss of time can also occur between the moment of visual recognition of the target and identification of its location to the computer.

With the system of the present invention the requirement for manipulative skill can be avoided, and loss of time between visual recognition and identification of the target to the computer, can be very much reduced. In the latter respect identification of target location to the computer is provided in the present system in accordance with measurements of the pilot's eye-position at the instant he signifies his recognition of a target. The equipment involved in these measurements is illustrated in greater detail in FIG. 3.

Figure 3:
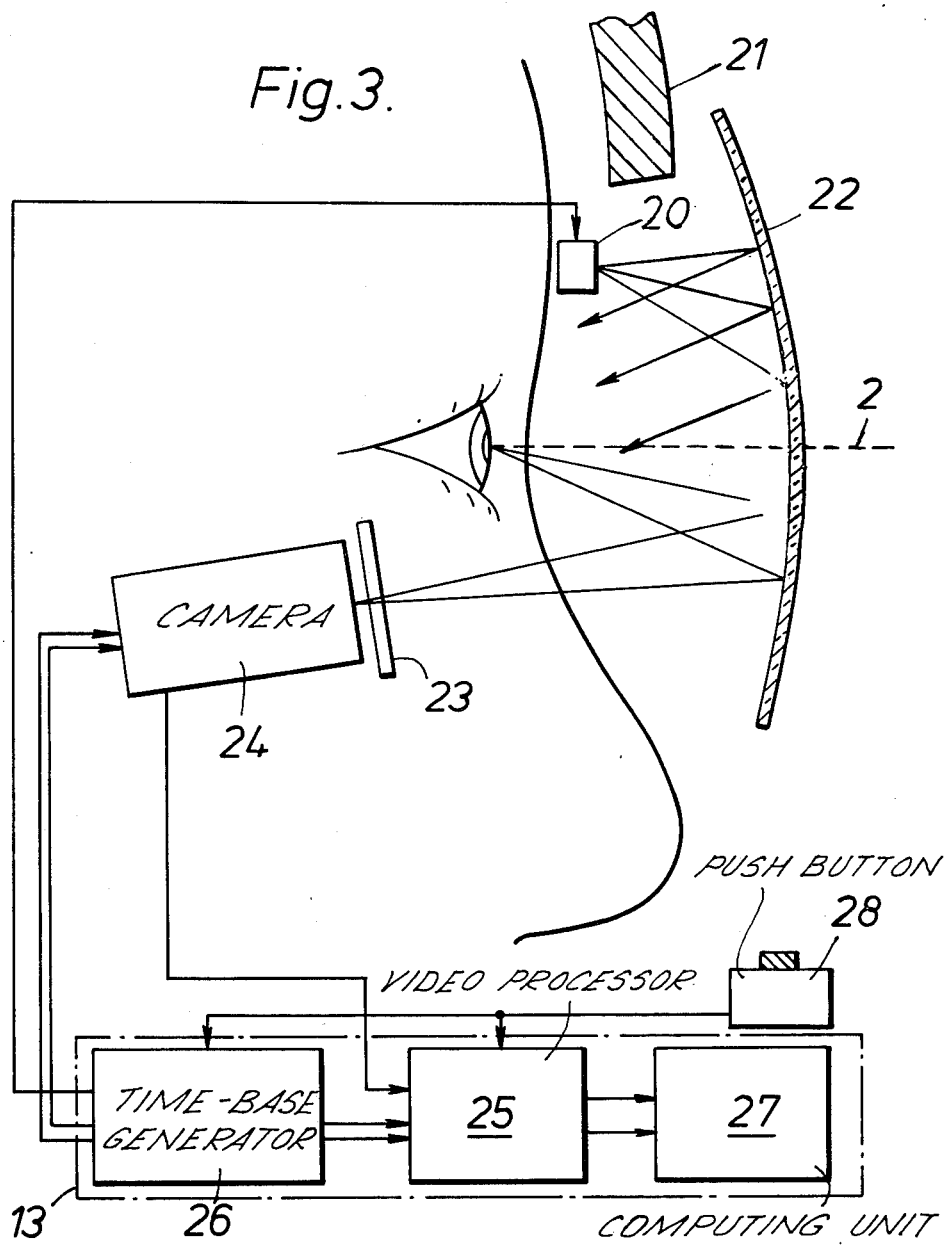
FIG. 3 illustrates details of the system of FIG. 1 on an enlarged scale.

Referring more especially to FIG. 3, a source 20 of near infra-red radiation (for example a gallium-arsenide light-emitting diode) is mounted on the helmet 21 worn by the pilot so that the light it emits illuminates one of his eyes by reflection from the inside of the helmet visor 22. The image in the visor 22 of the illuminated eye is scanned via a narrow-band infra-red filter 23 by a vidicon camera 24 that is also mounted on the helmet 21.

The video signals derived by the camera 24 are supplied to a video-signal processor unit 25 within the computer 13 and are there analyzed to derive measurements of the position of the centre of the eye within the scanned field. The analysis carried out is based on the variation in degree of reflected radiation that occurs from sclera to iris, or from iris to pupil, of the eye. In this the position of the eye-centre is determined by reference to the phasing of the maximum 'dark' or 'black' pulse within the line and frame time-bases of the camera-scanning raster defined by a time-base generator 26. The scanning of the eye within the field of the camera 24, together with waveforms of the consequent signals derived during successive line-scans, is illustrated diagrammatically in simplified form in FIG. 4.

Figure 4:
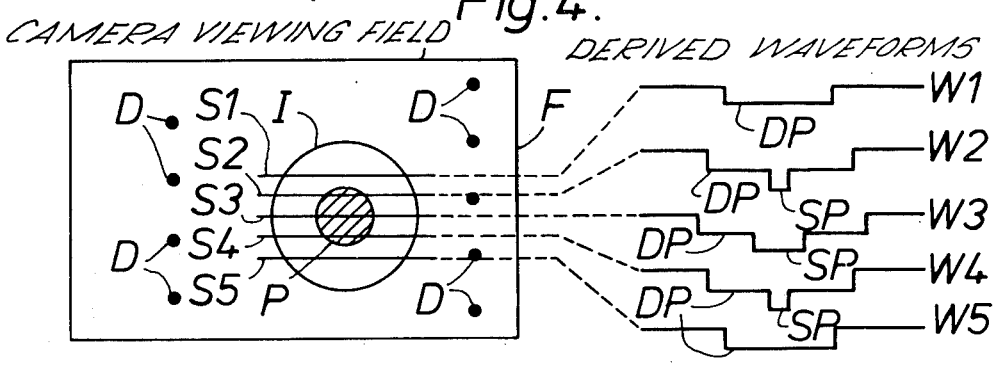
FIG. 4 is illustrative of the image field scanned by a camera of the system and also of waveforms derived during such scanning.

Referring to FIG. 4, the images I and P of the iris and pupil of the pilot's eye appearing within the field F of the camera 24 are scanned repeatedly as part of the conventional scanning of the whole field F performed by the camera 24. The line scans that intersect the iris image I (illustrated generally by lines S1 and S5) give rise to video signals having waveforms W1 to W5 with distinct 'dark' pulses DP, of the general form illustrated to the right-hand side of FIG. 4. Certain of these waveforms (W2, W3, W4) are characterised by a secondary 'black' pulse SP depending upon whether the relevant scan intersects the pupil image P. The video signal for which the duration of the pulse DP, or of the secondary pulse SP, is the longest (W3) may be readily identified by computation or a comparison process carried out in the unit 25. More particularly, the phasing within the scanning frame A of the line scan (S3) that intersects the eye-pupil image P across, or most closely across, a diameter is determined so as thereby to derive a coordinate Y of the centre-point of the eye. The other coordinate X of the eye-centre is determined from the instant in the identified line scan at which the mid-point of the relevant pulse occurs.

Referring again more especially to FIG. 3, the coordinates X, Y of the centre-point of the eye are derived in the processor unit 25, and are entered into the computing unit 27 of the computer 13 only in response to depression of a pushbutton 28 that, together with the camera 24, is connected to the computer 13 via a multi-lead cable 29 (Flg. 1). The pilot operates the pushbutton 28 as soon as he recognizes a suitable target and while he has his eye fixed on it. The unit 25 responds to operation of the button 28 to command via the waveform generator 11 immediate introduction of a symbol (for example, the symbol 9) into the projected display, or emphasis of an existing symbol (for example, by brightening up the symbol 9 already displayed), to which the pilot then rapidly transfers his attention. Once his eyes are trained on the introduced or emphasized symbol the pilot again operates the pushbutton 28 to enter the coordinates of the centre-point of the eye in the new position, into the computing unit 27. The position in the display corresponding to these latter coordinates is known and is used as the reference or origin from which the unit 27 computes (using the first-entered coordinates) the appropriate shifts that are to be applied to the symbol 9 for appropriate registration with the identified target. The waveform generator 11 responds to the computed shifts to bring the symbol 9 rapidly into register with the target in the display, and also to apply the appropriate corrections required to maintain it in such relationship irrespective of the movement of the aircraft and changes in its attitude, signalled by the sensors 12.

Figure 5:
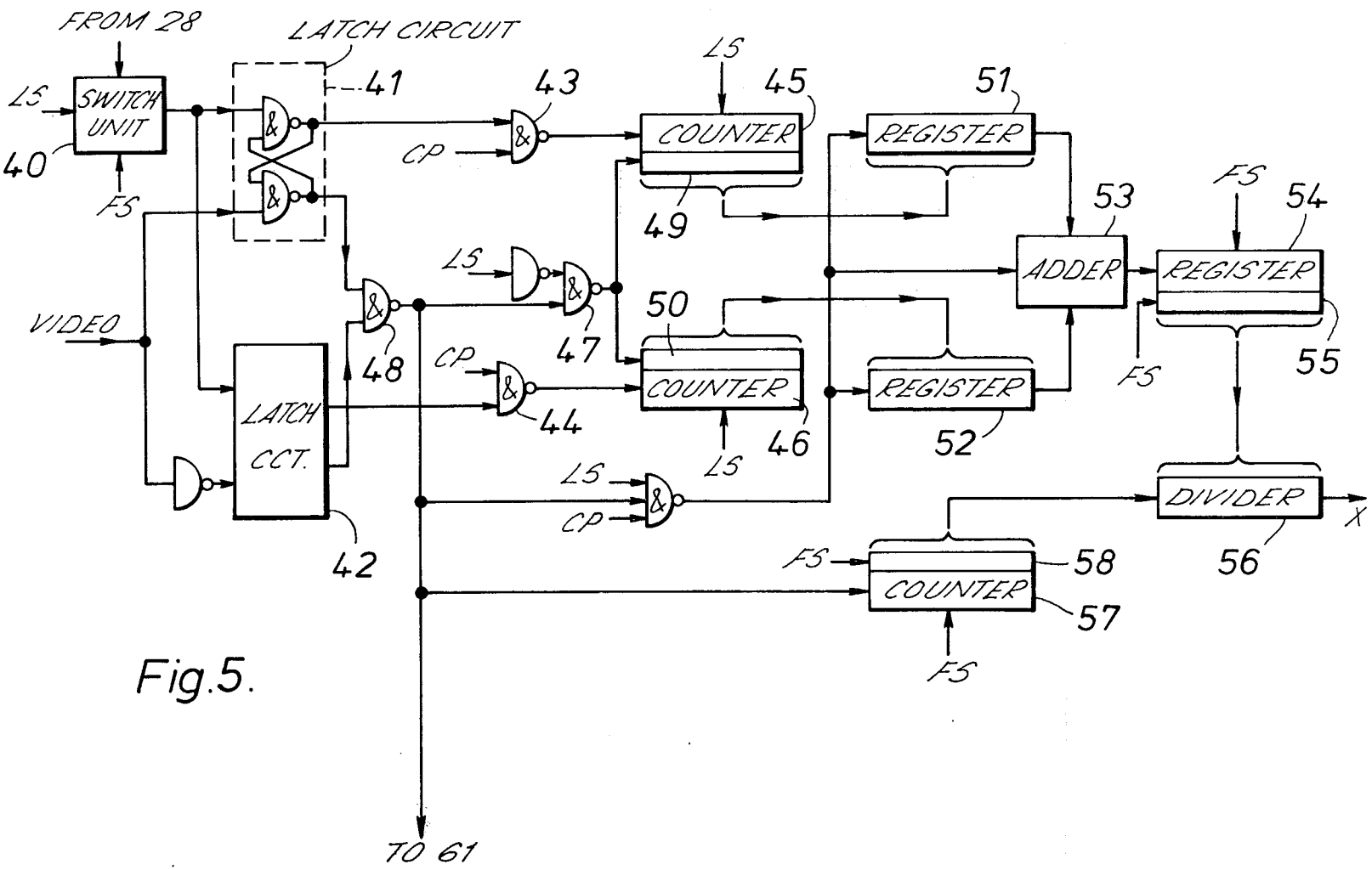
FIGS. 5 and 6 are block schematic representations of circuitry that may be used in the system.
Figure 6:
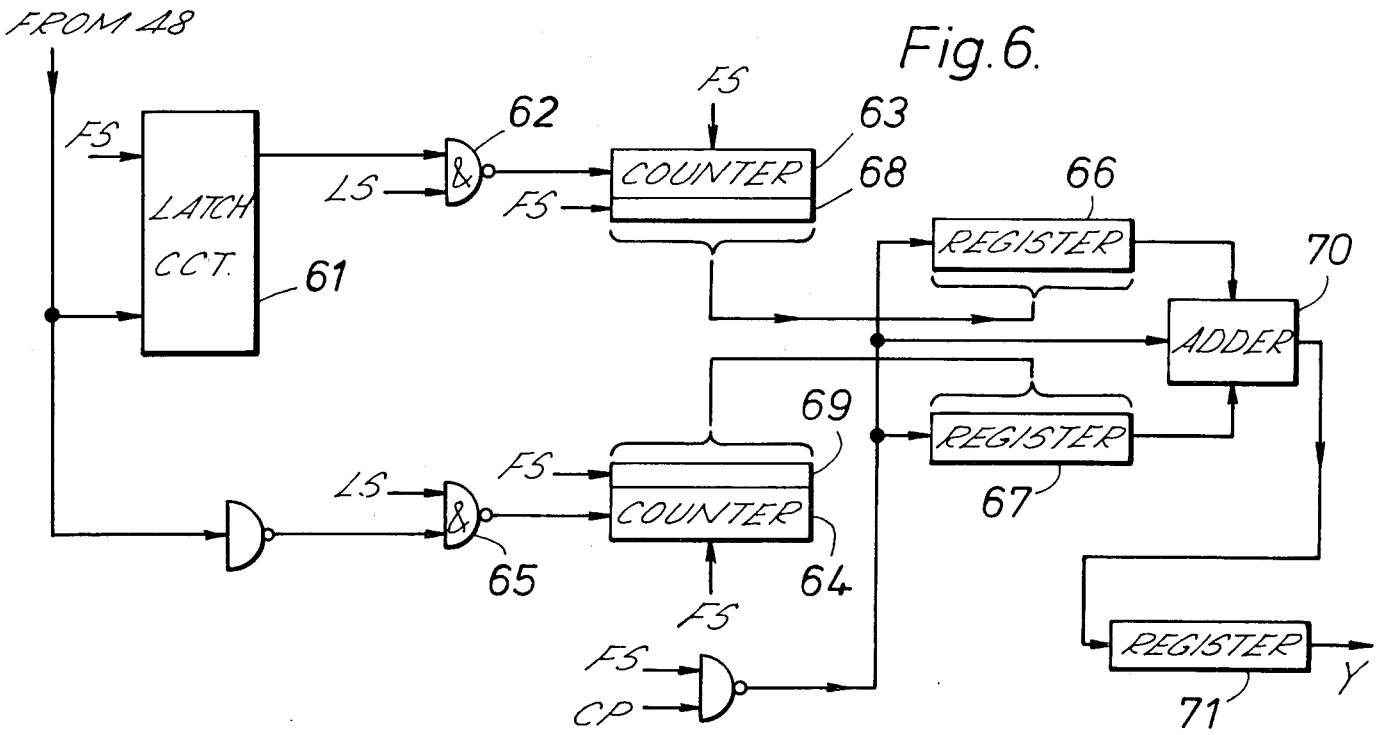

The function of the processor unit 25 in deriving the coordinates X, Y of the centre of the eye, may be implemented using appropriate programming of a general-purpose processor, or alternatively using special-circuits such as illustrated in FIGS. 5 and 6.

Referring to FIG. 5, operation of the pushbutton 28 acts via a switch unit 40 to enable supply of the line-synchronization pulses LS to two latch circuits 41 and 42 throughout one complete scanning frame. The latch circuits 41 and 42 are set by the trailing edge of each synchronization pulse LS to the condition in which clock pulses CP are supplied via gates 43 and 44 to two counters 45 and 46 respectively. The line-synchronization pulses LS are applied to clear the counters 45 and 46 so that from the beginning of each line-scan there is a gradual increase of count in each counter 45 and 46 in accordance with the progress of the scan.

The video signals derived in each line-scan are applied to the latch circuits 41 and 42. Both circuits 41 and 42 are reset by any pulse DP (FIG. 4) occurring in the scan, the circuit 41 by the leading edge and the circuit 42 by the trailing edge. (In the present example the determination of the coordinates X and Y is to be related to the pulses DP rather than to the alternative pulses SP; however the principle of operation would be exactly the same for the alternative case, the latch circuits 41 and 42 being in that event responsive for resetting purposes, to the leading and trailing edges respectively of the secondary pulses SP.) Resetting of the latch circuit 41 halts counting by the counter 45, and the subsequent resetting of the latch circuit 42 halts counting by the counter 46. The counts accumulated by the counters 45 and 46 in these circumstances are accordingly representative of the X-coordinates of the boundary of the iris image I on the relevant scan line.

A gate 47 detects the condition in which the resetting of both latch circuits 41 and 42 is signalled by a gate 48 within the period of the line-scan (more particularly outside the period of any line-synchronization pulse LS). The response of the gate 47 to this condition is signalled to gating units 49 and 50 which thereupon transfer the contents of the counters 45 and 46 respectively into registers 51 and 52. It is only in the event that a pulse DP occurs within the line-scan that both latch circuits 41 and 42 are reset and give rise to the condition in which the contents of the two counters 45 and 46 are transferred into the resisters 51 and 52. Thus throughout the period of the one scanning frame there are transferred into the registers 51 and 52 pairs of counts related solely to successive line-scans of the iris image I in that frame.

The two counts of each successive pair transferred into the registers 51 and 52 are added together in an adder 53. The resultant sum is transferred into a register 54 to be accumulated with the sums derived from the other pairs of counts during the frame. The total accumulated by the register 54 is transferred via a gating unit 55 into a divider unit 56 upon the next frame-synchronization pulse FS at the end of the frame period. The count of a counter 57 is at the same time transferred into the unit 56 via a gating unit 58, this count, which is derived from the output signals of the gate 48, being representative of the number N of counts that during the period have been accumulated in the register 54. The divider unit 56 divides the total transferred from the register 54 by the number N, and thereby derives an output value of the X-coordinate of the centre of the eye in terms of the mean of all the X-coordinate representations of the boundary of the iris image I derived during the frame-scan.

The Y-coordinate corresponding to the derived X-coordinate of the eye-centre is derived in accordance with a count of the number of line-scans made from the beginning of the one frame period until the occurrence of the first output signal from the gate 48 signifying that the line-scanning has reached the iris image I. To this end, and referring to FIG. 6, a latch circuit 61 is set by the frame-synchronization pulse FS to the condition in which the line-synchronization pulses LS of the frame are supplied via a gate 62 to a counter 63. Counting of the pulses LS by the counter 63 is halted when the latch circuit 61 is reset by the first output signal from the gate 48, but is now begun by a counter 64. The counter 64 receives the pulses LS via a gate 65 throughout that part of the frame-scan for which there are output signals from the gate 48, namely throughout the period of line-scanning or the iris image I. Thus the counters 63 and 64 accumulate counts that are in accordance respectively with the Y-coordinate representative of the boundary at the uppermost part of the iris image I and the diametral distance measured in the Y-coordinate direction to the lowermost part of that image I.

The counts accumulated in the counters 63 and 64 are transferred into registers 66 and 67 via respective gating units 68 and 69 in response to the leading edge of the next frame-synchronization pulse FS at the end of the frame period. The count of the counter 64 is transferred into the register 67 with a shift of one digit place in order to effect division by two, and the content of the register 67 is then added to that of the register 66 in an adder 70. This sum as entered into a register 71 provides the Y-coordinate of the eye-centre.

The computing unit 27 responds to the two sets of coordinates of eye position entered in succession from the processor unit 25 to compute the effective difference between them. Compensation for movement of the pilot's head between entry of the two sets of coordinates is introduced into the computation. This is achieved by reference to a pattern of point-source images that is projected into the image plane of the camera 24 from two upright parallel arrays 30 of equally-spaced points of infra-red light (for example arrays of gallium-arsenide diodes) located to either side of the reflector 1. Throughout the range of possible movement of the pilot's head when viewing through the reflector 1, there are at least two points of each array within the field of the camera 24. This is illustrated in FIG. 4, where the images D of the points in the two arrays are shown within the field F.

The unit 25 acts to determine the head-position parameters required for compensation of the computed eye-position coordinates, by reference to those components of the video signals from the camera 24 that arise from the images D. Lateral and vertical translations of the pattern of images D within the field F between the two measurements of eye-position, correspond to the lateral and vertical movements of the head in the intervening period, whereas a change in the distance between successive images D in each array-pattern (or between the two patterns) corresponds to a change in distance between the head and the display reflector 1. A change in alignment between the images D of the two array-patterns, on the other hand, is indicative of rotation of the head to one side or the other about the line-of-sight 2. Whichever the case, the unit 25 responds to the change by analysis of the video signals it receives, to apply the relevant compensation, linear shifts in the case of either lateral or vertical translation of the head, change of scaling in the case of movement towards or away from the reflector 1, and rotation of axes in the case of rotation of the head.

The components of the video signals from the camera 24 corresponding to the images D are readily detected in the unit 25 on the basis of their 'white' level and limited signal-duration. The spacing between successive images D of each array can be readily measured using one or more circuits corresponding to that of FIG. 6, adapted to count the number of line scans between the detected image-signals. Similarly, circuits corresponding to those of FIGS. 5 and 6 can be adapted to provide measurements of the lateral and vertical translations of the pattern of images D within the field F, and of changes of alignment between the two array-patterns. The measurements derived are all conveyed to the computing unit 27 from the unit 25 and are there applied, using straightforward trigonometrical techniques in the shift-computation, to effect the desired compensation for head-position movement.

It is important to note that absolute measurement of head position is not necessary. It is only necessary that the measurements are made at the same time as those of eye-position. Furthermore, an important feature of the system as a whole is the use of the display-defined referencing of the coordinate system immediately after the initial target identification measurement. In this manner there is no requirement for an absolute system of measurement with long-term stability as otherwise required. The techniques described enhance the capability of the weapon-delivery system in regard to targets of opportunity and for the designation of multiple targets in a short time period and the storage of such designations for second-pass attacks. Although these techniques have been described above in relation to a head-up display system they are also applicable to designation and marking of visually-recognized targets on a head-down display, and also to systems where the external scene is itself presented as a display derived from, say, a television or infra-red camera or from radar.

I claim:

1. A system for providing identification of a point of interest in a field of view of an observer comprising means operable to provide a measure of eye position of the observer when the observer is looking at said point, means to define a reference point relative to said field of view, means operable to provide a measure of eye position of the observer when the observer is looking at said reference point, and means responsive to the two said measures of eye position to provide a representation identifying said point of interest relative to said reference point.

2. A system according to claim 1 including camera means to scan the observer's eye to derive electric video-signals in accordance therewith, said camera means scanning said eye with a raster scan according to frame and line time-bases, means responsive to said video signals to detect in each line-scan the occurrence of signal changes due to variation in reflectance along the scan of the eye, and means for deriving coordinates of the center of the eye-pupil in accordance with analysis of the said signal changes detected, in relation to said frame and line time-bases.

3. A system according to claim 1, including an imaging sensor for viewing the observer's eye to derive electric video-signals in accordance therewith, means for analyzing the said signals to determine coordinates of the center of the eye pupil.

4. A system according to claim 3 including means to illuminate the observer's eye with infra-red radiation, and wherein said imaging sensor is responsive to infra-red radiation reflected from the eye.

5. A system according to claim 3 including means responsive to movement of the observer's head in the interval between the said two measurements, and means to introduce into said identifying-representation compensation for such movement.

6. A system comprising means to define a field of view of an observer, means to provide a display within said field to be viewed by said observer, means defining a reference point with respect to said display, means operable by the observer when viewing a point in the said field to signify that point as a selected point, means to provide two measures of eye position of the observer, one of said measures relating to eye-position when the observer is viewing the said reference point and the other relating to eye-position when the observer is viewing said selected point, means responsive to said two measures to compute therefrom coordinate identification of said selected point with respect to said display, and further means responsive to said coordinate identification to perform a predetermined function in respect of said selected point.

7. A display system according to claim 6 wherein said reference point is a marker moveable in said display, and wherein said further means includes means to move said marker to said selected point in accordance with said coordinate identification.

8. A display system according to claim 6 wherein the said means to provide measures of eye-position includes an imaging-sensor for viewing the observer's eye and deriving electric video-signals in accordance therewith, and means for analyzing said signals to derive coordinate representation of the center of the eye-pupil.

9. A display system according to claim 6 wherein the said means to provide measures of eye-position includes camera means to scan the observer's eye to derive electric video-signals in accordance therewith, said camera means scanning said eye with a raster scan according to frame and line time-bases, means responsive to said video signals to detect in each line-scan the occurrence of signal changes due to variation in reflectance along the scan of the eye, and means for analyzing said video signals to derive in accordance with said signal changes coordinates of the center of the eye-pupil related to said frame and line time-bases.

10. A system according to claim 6 including means responsive to movement of the observer's head in the interval between successive measurements of eye position, and means to introduce into said coordinate identification compensation for such movement.

11. A system for providing a measure of movement of the head of an observer, comprising first means for presenting to the observer a distinctive optical pattern, second means for viewing said pattern to produce electric video-signals in accordance therewith, means for mounting one of the said first and second means on the observer's head, and means for analyzing video signals supplied by said second means to detect changes therein and thereby provide said measure of head movement.

12. A system according to claim 11 wherein said mounting means is means for mounting said second means on the observers's head, and wherein said second means is mounted to view said pattern as reflected in an eye of the observer.

13. A method for providing identification of a point of interest in an observer's field of view, comprising the steps of deriving successive measures of eye position of the observer, one of the measures being derived when the observer views a reference point defined relative to said field and the other when the observer views said point of interest, and deriving from the two said measures of eye position a respesentation identifying said point of interest relative to said reference point.

14. A method according to claim 13 including the step of providing a measure of head movement of the observer in the interval between the successive measurements of eye position, and applying the said measure of head movement to compensate in said identifying representation for said such movement.

* * * * *